US009236214B2

(12) United States Patent
Watson

(10) Patent No.: US 9,236,214 B2
(45) Date of Patent: Jan. 12, 2016

(54) ELECTRON TUBE

(75) Inventor: Victor Leslie Watson, Chelmsford (GB)

(73) Assignee: E2V Technologies (UK) Limited, Chelmsford (GB)

( * ) Notice: Subject to any disclaimer, the term of this patent is extended or adjusted under 35 U.S.C. 154(b) by 0 days.

(21) Appl. No.: 13/980,260

(22) PCT Filed: Jan. 18, 2012

(86) PCT No.: PCT/GB2012/050099

§ 371 (c)(1),
(2), (4) Date: Sep. 30, 2013

(87) PCT Pub. No.: WO2012/098391

PCT Pub. Date: Jul. 26, 2012

(65) Prior Publication Data

US 2014/0021859 A1 Jan. 23, 2014

(30) Foreign Application Priority Data

Jan. 21, 2011 (GB) ..... 1101062.6

(51) Int. Cl.

| | |
|---|---|
| ***H01J 25/50*** | (2006.01) |
| ***H01J 23/00*** | (2006.01) |
| ***H01J 23/12*** | (2006.01) |
| ***H01J 25/587*** | (2006.01) |

(52) U.S. Cl.

CPC ..... *H01J 25/50* (2013.01); *H01J 23/005* (2013.01); *H01J 23/12* (2013.01); *H01J 25/587* (2013.01)

(58) Field of Classification Search

CPC ..... H01J 25/587; H01J 25/50; H01J 25/00

USPC ..... 315/500–507

See application file for complete search history.

(56) References Cited

U.S. PATENT DOCUMENTS

| | | | | |
|---|---|---|---|---|
| 5,187,408 | A | 2/1993 | Jodicke et al. | |
| 5,469,024 | A | 11/1995 | Kirshner et al. | |
| 6,351,071 | B1 * | 2/2002 | Itoh | 315/39.51 |

(Continued)

FOREIGN PATENT DOCUMENTS

| | | | |
|---|---|---|---|
| CN | 1290142 | C | 12/2006 |
| CN | 100485855 | C | 5/2009 |

(Continued)

OTHER PUBLICATIONS

International Search Report of PCT/GB2012/050099 filed Mar. 3, 2012.

(Continued)

*Primary Examiner* — Tuyet Vo
*Assistant Examiner* — Henry Luong
(74) *Attorney, Agent, or Firm* — Venable LLP; Robert Kinberg

(57) ABSTRACT

A magnetron has an anode body (1) and including a ceramic sleeve (7). In higher power generators, stray radiation is emitted from this sleeve in addition to the main power launched from the antenna into the waveguide (2), and RF absorbing material is provided. Such absorbers, however, tend to be frequency-selective, and can overheat. According to the invention, a non-metallic jacket (13) containing a dielectric liquid such as water surrounds the sleeve. This provides absorption over a broad band of frequencies, and it is easy to make the jacket have a sufficiently high thermal capacity, for example, by arranging a flow of liquid through it.

12 Claims, 3 Drawing Sheets

(56) References Cited

U.S. PATENT DOCUMENTS

| | | | | |
|---|---|---|---|---|
| 2007/0095823 | A1* | 5/2007 | Sedlmayr | 219/688 |
| 2007/0151847 | A1* | 7/2007 | Lee | 204/298.19 |
| 2011/0012508 | A1 | 1/2011 | Leonhardt | |

FOREIGN PATENT DOCUMENTS

| | | | |
|---|---|---|---|
| CN | 201478250 | U | 5/2010 |
| EP | 1003198 | A1 | 5/2000 |
| EP | 2023371 | A2 | 2/2009 |
| GB | 2 259 181 | A | 3/1993 |
| GB | 2372147 | A | 8/2002 |
| GB | 2478990 | A * | 9/2011 |
| JP | 61284031 | | 6/1988 |
| WO | WO-2011117654 | | 9/2011 |

OTHER PUBLICATIONS

United Kingdom Search Report in Application No. GB1101062.6 mailed May 19, 2011.

Office Action from State Intellectual Property of the People's Republic of China Issued May 26, 2015 for Application No. 201280013253.1 with English Translation.

* cited by examiner

ELECTRON TUBE

This invention relates to electron tubes, especially having means to reduce stray radiation therefrom.

It has been proposed to provide, in the case of a gyrotron in which are generated undesired microwaves which disturb the internal operation of the gyrotron, an internal water jacket to absorb the microwaves, combined with a surrounding metal wall to prevent the stray microwaves from emerging from the gyrotron (U.S. Pat. No. 5,187,408).

It has also been proposed to provide, in the case of a klystron, a tube in the form of a helix surrounding the region between the collector and the RF output circuit of the klystron, through which tube water is passed to absorb microwave power leaking from this region (JP 61284031).

The invention provides a magnetron having an absorber to absorb stray microwave radiation emerging therefrom, wherein the absorber comprises a non-metallic jacket containing a dielectric liquid Such an absorber can absorb over a wide thermal range, and may be arranged to have a high thermal capacity.

Advantageously, the jacket surrounds an insulating sleeve forming part of the vacuum envelope, and supply leads for the cathode which may also support the cathode, may extend through the sleeve.

The jacket may include a cooling circuit to permit liquid to flow through the jacket. If the magnetron includes a water-cooled electromagnet for providing the main field, a single supply may be connected to the cooling circuit for electromagnet and to a cooling circuit for the jacket.

Ways of carrying out the invention will now be described in greater detail, by way of example, with reference to the accompanying drawings, in which.

Figure 1:
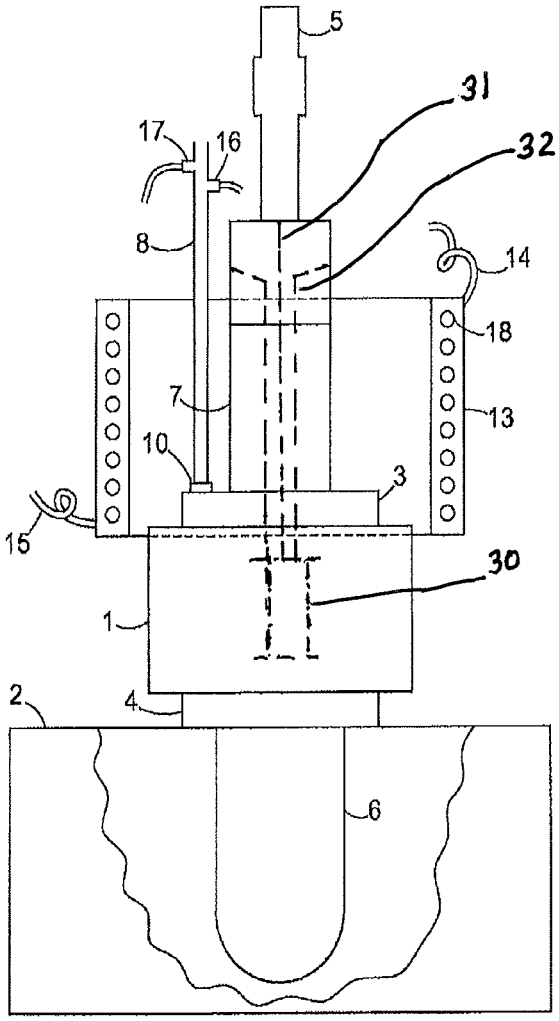
FIG. 1 is a schematic front view of a first magnetron shown in a partly cut-away waveguide, with a water jacket shown in axial cross-section.
Figure 2:
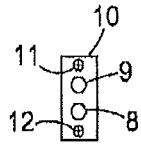
FIG. 2 is a top plan view of a detail of the FIG. 1 arrangement.

Referring to the FIGS. 1 and 2 of the drawings, the first magnetron has an anode body 1 through which a cathode (not shown) extends, mounted in a waveguide 2. The axial magnetic field through the magnetron is generated by an electromagnet (not shown) which surrounds the anode body, in conjunction with pole pieces 3, 4. An additional pole piece (not shown) surrounds the pole piece 3 and is bolted to the electromagnet. The cathode is connected at one end to supply terminal 5, while a filament region of the cathode which emits electrons extends through the usual interaction region in the anode body. The anode body includes vanes (not shown), the lower ends of which are connected to an antenna contained in a ceramic dome 6 forming part of the vacuum envelope of the magnetron, which antenna launches the microwaves generated by the magnetron into the waveguide 2, which is shown partly cut-away.

The body of the magnetron is typically grounded, and the cathode supply terminals are typically at tens of kilovolts of negative potential. The vacuum envelope of the magnetron includes a sleeve 7 of ceramic material holding off this potential difference, and the sleeve is co-extensive with the part of the cathode which supports the filament region and connects to the supply terminals.

A considerable quantity of heat is generated in the anode body 1, both due to the cathode and due to the electromagnet, and it is customary to have water-cooling by means of cooling passages in the body. The inlet to the cooling circuit is a water pipe 8, and the outlet an identical pipe 9 which is hidden behind the pipe 8 in FIG. 1. The bottom ends of the pipes are in communication with cooling passages in the anode body. The pipes are secured to a bracket 10 which is bolted onto pole-piece 3 by means of bolts 11, 12, compressing O-rings therebetween to prevent leakage As described, the microwaves generated by the magnetron are launched into the waveguide 2, but the region of the magnetron above the anode body 1 may also be capable of radiating power, since the ceramic sleeve 7 is essentially transparent to microwave power. It would be usual to provide chokes within the region of the magnetron within the sleeve 7, to reduce the stray power radiated along the cathode in the direction away from the antenna, but this is not always sufficient to reduce the radiated power to a sufficiently low level. The magnetron may be as described in our published International patent application WO 2011117654, in which, with reference to the present application, the axis of the anode 1 extends in the upright direction (as seen in FIG. 1 of the present patent application), in which the cathode is formed by a helical filament 30 extending parallel to the axis of the anode 1, and in which the filament 30 is supplied with voltage via coaxial supply/support arms, comprising a core 31 surrounded by a concentric sleeve 32, which extend through the sleeve 7. At higher magnetron powers, stray radiation through the sleeve 7 can be a serious problem. Filament 30, core 31 and concentric sleeve 32 are shown in dashed lines because they would not normally be visible in the elevation view of the ceramic sleeve 7 and anode 1 shown in FIG. 1.

There are in fact quite stringent requirements for the bandwidth and power levels over which equipment operating at microwave frequencies can radiate. Stray radiation may be emitted at the upper end of the magnetron (as seen in the drawing) at the operating frequency of the magnetron, but also at other frequencies. This is because the part of the cathode that extends through the sleeve 7 which supports the filament region on the one hand, and connects to the supply terminal 5 on the other hand, may create resonances at frequencies other than the basic design frequency of the magnetron. Other components of the magnetron, for example, those provided for conducting heat away, may produce the same effect. The result is that the sleeve 7 may radiate stray radiation at many different frequencies. This stray radiation can render electronic equipment in the vicinity non-functional.

In accordance with the invention, the sleeve 7 is surrounded by a water-containing non-metallic hollow jacket 13. The water-containing jacket includes a cooling circuit having a coiled inlet pipe 14 and a coiled outlet pipe 15. The water is able to absorb radiation over a wide frequency range.

The other ends of the coiled water inlet and outlet pipes 14, 15 are connected to respective T-junctions 16, 17 in inlet pipe 8 for the anode body.

Within the hollow jacket, the cooling circuit comprises a coiled pipe 18 which connects to the pipe 14 at the inlet and to pipe 15 at the outlet, even though the surrounding space within the jacket is also filled with water. This is a safety feature, since in the event of damage to the jacket leading to leakage, there is a comparatively small volume of water which can escape. By contrast, the flowing water is wholly contained in pipes 14-18. These pipes can all be made of metal, for example, copper, in order that they can withstand a high pressure without risk of leakage. Further, the diameter of the pipes is much less than that of the pipe 8 in order to restrict water flow, and a flow restrictor may be provided in T-junction 16 to limit the flow through the jacket 13 further.

The hollow jacket 13 is spaced from the sleeve 7 in the radial direction, since it would be undesirable to have sufficiently close arrangement that moisture created by condensation could build up.

The hollow jacket 13 may be made of plastics material.

In addition to the shielded magnetron arrangement of the invention, the invention is also applicable as a retro-fit arrangement, which would be particularly easy to accomplish if the magnetron was already provided with a bracket 10 for the anode body cooling circuit.

It is not essential for there to be a continuous water flow. If desired, the pipes 14-18 could be dispensed with, so that the jacket is water-filled but without any circulation.

Variations may of course be made without departing from the scope of the invention. Thus, the jacket 13 could be made of other non-metallic materials apart from plastics material, for example, ceramics material. The jacket, in the case where no flow takes place, could be made of two halves which are brought together to surround the sleeve 11. This is particularly advantageous in a retro-fit arrangement since it would not be necessary to modify the anode body cooling circuit at all. Additives such as salt may be added to the water, so as to vary the absorption characteristics of the dielectric. Further, the dielectric material in the jacket does not have to be water, other dielectric liquids could be used.

Figure 3:
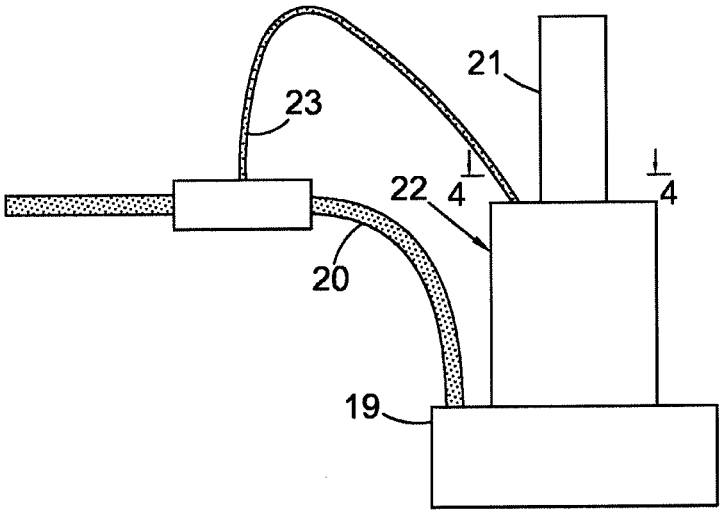
FIG. 3 is a schematic front view of part of a second magnetron.
Figure 4:
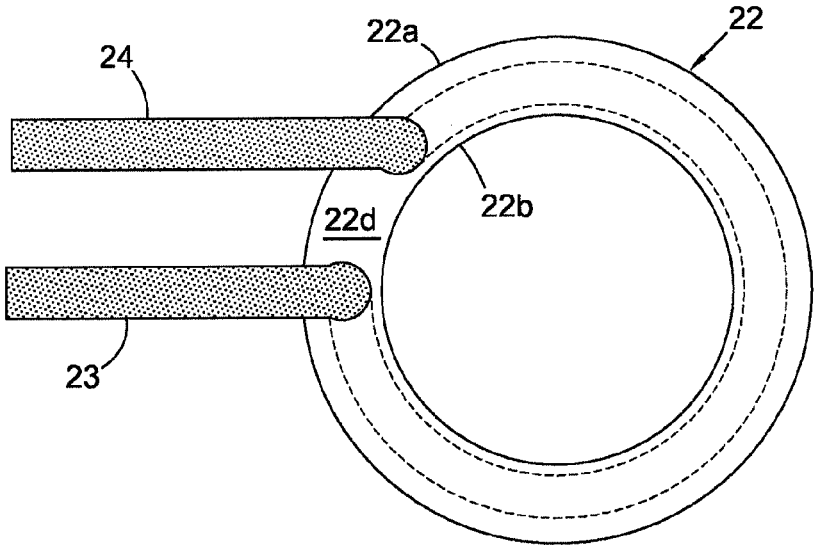
FIG. 4 is a schematic axial cross-section of a part of the second magnetron taken through the plane 4-4 in FIGS. 3 and 5.
Figure 5:
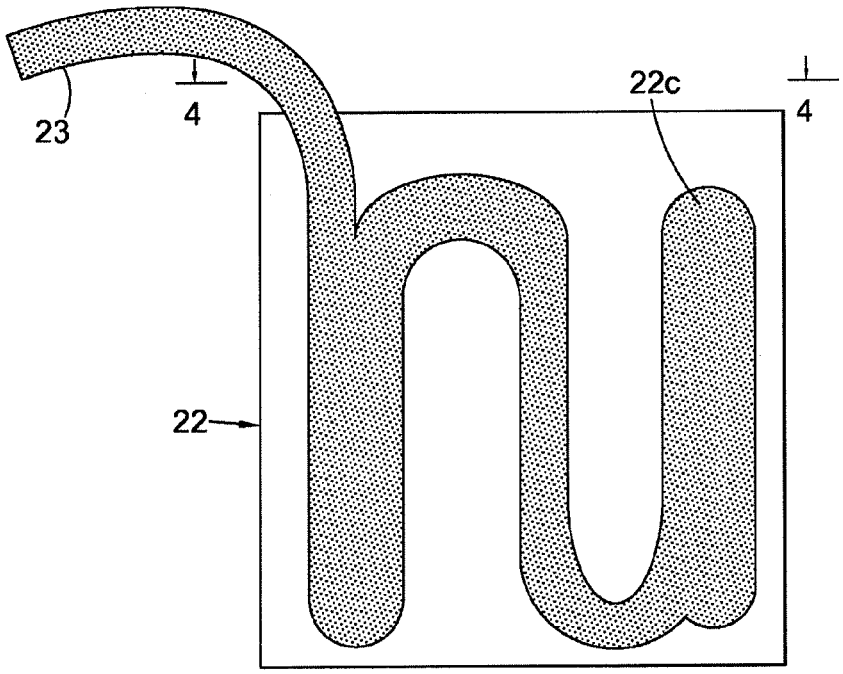
FIG. 5 is a schematic front view of a detail of the second magnetron shown in FIG. 3.

Referring to FIGS. 3 to 5 of the drawings, the second magnetron includes an anode block 19 which is water-cooled by a water circuit consisting of an inlet pipe 20, and an outlet pipe which is hidden in the view of FIG. 3 by the inlet pipe. The ceramic dome containing the antenna is not shown, and the ceramic sleeve leading to the HT supply terminals, generally referred to as the sidearm, is shown schematically and denoted by the reference numeral 21. In contrast to the first magnetron, a non-metallic water-containing jacket indicated generally by the reference numeral 22 is arranged between the inlet pipe 20 and the sidearm 21. The water-containing jacket 22 contains a cooling circuit, the inlet to which is from pipe 23, and the outlet from pipe 24. These pipes are tapped from the respective anode cooling inlet and outlet pipes.

The diameter of the pipes leading to and from the water jacket is much narrower than those leading to and from the anode cooling circuit. Hence, the incoming water flow has a low impedance path to the anode cooling circuit, and a high impedance cooling path to the cooling circuit in the radiation absorbing jacket 22. Only a relatively small amount of cooling of the absorber is needed, and the main flow is to the anode block.

Referring to FIGS. 4 and 5, the water jacket 22 has outer 22*a* and inner 22*b* walls, containing water. The high impedance cooling circuit 22*c* is undulating in form and shaped in a cylindrical configuration, so it can be a push-fit in the space between the inner and outer walls 22*a*, 22*b*. The space is filled with water and sealed with an annulus 22*d* at the top.

The invention claimed is:

1. A magnetron having an axial direction, comprising: a vacuum envelope; an electrically insulating sleeve forming part of the vacuum envelope; supply leads for connecting to a magnetron cathode and extending through the insulating sleeve; and having an absorber to absorb stray microwave radiation radiated through the electrically insulating sleeve, the absorber comprising a non-metallic jacket containing a dielectric liquid, wherein the jacket surrounds the electrically insulating sleeve.

2. The magnetron as claimed in claim 1, in which the electrically insulating sleeve is extensive in the axial direction of the magnetron.

3. The magnetron as claimed in claim 1, in which the electrically insulating sleeve comprises a sidearm.

4. The magnetron as claimed in claim 1, in which the jacket includes a cooling circuit to permit liquid to flow through the jacket.

5. The magnetron as claimed in claim 4, in which the cooling circuit comprises a coiled pipe within the jacket to contain the flowing liquid.

6. The magnetron as claimed in claim 4, in which the cooling circuit comprises a pipe which has undulations including sections parallel to the axis of the magnetron and extends around a periphery of the jacket.

7. The magnetron as claimed in claim 1, in which the dielectric liquid comprises water.

8. The magnetron as claimed in claim 1, in which the jacket comprises a plastics material.

9. The magnetron as claimed in claim 1, in which the magnetron includes a water-cooled electromagnet having a cooling circuit for providing a main field, and a single supply is connected to the cooling circuit for the electromagnet and to a cooling circuit for the jacket.

10. The magnetron as claimed in claim 1, in which the magnetron includes a water-cooled anode-block and a single supply is connected to the cooling circuit for the anode and to a cooling circuit for the jacket.

11. The magnetron as claimed in claim 10, in which incoming water flow has a low impedance path to the cooling circuit for the anode and a high impedance path to the cooling circuit for the jacket.

12. The magnetron as claimed in claim 1, wherein the non-metallic jacket is a hollow jacket containing the dielectric liquid, surrounding and sufficiently spaced from the insulating sleeve to prevent build-up of moisture by condensation.

* * * * *